US006561106B2

(12) United States Patent
Tseng

(10) Patent No.: US 6,561,106 B2
(45) Date of Patent: May 13, 2003

(54) FOLDING TABLE

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 9 days.

(21) Appl. No.: 09/954,108

(22) Filed: Sep. 17, 2001

(65) Prior Publication Data

US 2003/0051642 A1 Mar. 20, 2003

(51) Int. Cl.[7] ..... A47B 3/00
(52) U.S. Cl. ..... 108/131; 248/439
(58) Field of Search ..... 108/124, 125, 108/126, 127, 129, 130, 131, 132, 160; 248/439, 166, 188.6; 297/158.4, 159.1

(56) References Cited

U.S. PATENT DOCUMENTS 2,148,823 A * 2/1939 Lapeyre ..... 108/131
2,278,810 A * 4/1942 Virtue et al. ..... 403/92
3,072,451 A * 1/1963 Greenberg et al. ..... 108/160
3,695,567 A * 10/1972 Weagle ..... 248/188.6
5,070,796 A * 12/1991 Marone et al. ..... 108/124
5,509,361 A * 4/1996 Chen ..... 108/131
5,921,623 A * 7/1999 Nye et al. ..... 297/158.4
5,983,807 A * 11/1999 Tarnay et al. ..... 108/132
6,471,173 B1 * 10/2002 Tseng ..... 248/439

* cited by examiner

*Primary Examiner*—Janet M. Wilkens
(74) *Attorney, Agent, or Firm*—Ladas & Parry

(57) ABSTRACT

A folding table includes support pedestals, side rails, and foldable support braces. Each of the support braces includes a rail connecting portion and a pedestal connecting portion. One of the pedestal connecting portion and the rail connecting portion of each of the support braces is formed with a notch, whereas the other of the pedestal connecting portion and the rail connecting portion of each of the support braces is formed with a projection extending into the notch to ensure that the support brace can be maintained at an extended state. Each of the support braces further includes a pivot fastener for connecting pivotally the pedestal connecting portion to the rail connecting portion, and a locking fastener to retain releasably the support brace at the extended state.

8 Claims, 7 Drawing Sheets

FOLDING TABLE

BACKGROUND OF THE INVENTION

1. Field of the Invention

The invention relates to a folding table, more particularly to a folding table which can prevent untimely folding thereof.

2. Description of the Related Art

A conventional folding table includes a table top, a pair of support pedestals pivotally attached to the table top, a pair of pivotal support braces and a retaining assembly. In order to enhance safety and structural stability, some of the conventional folding tables are relatively complex in structure. It is thus desirable to provide a folding table which is simple in structure, which is easy to extend, and which can prevent untimely folding thereof when the support braces of the folding table are at the extended state.

SUMMARY OF THE INVENTION

Therefore, the object of the present invention is to provide a folding table which is simple in structure and which can prevent untimely folding thereof.

Accordingly, the folding table of this invention includes a pair of support pedestals, a pair of side rails, a pair of foldable support braces, and a table top mounted on the side rails.

The support pedestals are spaced apart from each other in a longitudinal direction. Each of the support pedestals has a top end formed with an end rail that extends in a transverse direction transverse to the longitudinal direction and that has distal end segments opposite to each other in the transverse direction, and a bottom end adapted to be placed on a ground surface.

The side rails extend in the longitudinal direction and are spaced apart from each other in the transverse direction. Each of the side rails has opposite ends connected pivotally and respectively to an adjacent pair of the distal end segments of the end rails of the support pedestals such that the support pedestals are movable relative to the side rails between a folded position, where the support pedestals are disposed to lie adjacent to the side rails, and an unfolded position, where the support pedestals are disposed generally transverse to the side rails.

Each of the support braces props releasably a respective one of the support pedestals in the unfolded position, and includes a rail connecting portion and a pedestal connecting portion. The rail connecting portion has a first end section connected pivotally to the side rails, and an opposite second end section. The pedestal connecting portion has a first end segment connected pivotally to a respective one of the support pedestals, and an opposite second end segment that is disposed to lie against the second end section of the rail connecting portion. The rail connecting portion and the pedestal connecting portion are generally aligned with each other in an extended state of the support brace to prop the respective one of the support pedestals in the unfolded position.

The second end section of the rail connecting portion is formed with first and second fastener holes. The second end segment of the pedestal connecting portion is formed with a third fastener hole that is registered with the first fastener hole, and a fourth fastener hole that is registered with the second fastener hole when the support brace is at the extended state.

One of the second end segment of the pedestal connecting portion and the second end section of the rail connecting portion of each of the support braces is formed with a notch. The other of the second end segment of the pedestal connecting portion and the second end section of the rail connecting portion of each of the support braces is formed with a projection that extends into the notch to ensure that the fourth fastener hole is registered with the second fastener hole when the support brace is at the extended state.

Each of the support braces further includes a pivot fastener extending through the first and third fastener holes for connecting pivotally the second end segment of the pedestal connecting portion to the second end section of the rail connecting portion, and a locking fastener extending through one of the second and fourth fastener holes and removably engaging the other of the second and fourth fastener holes to retain releasably the support brace at the extended state.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
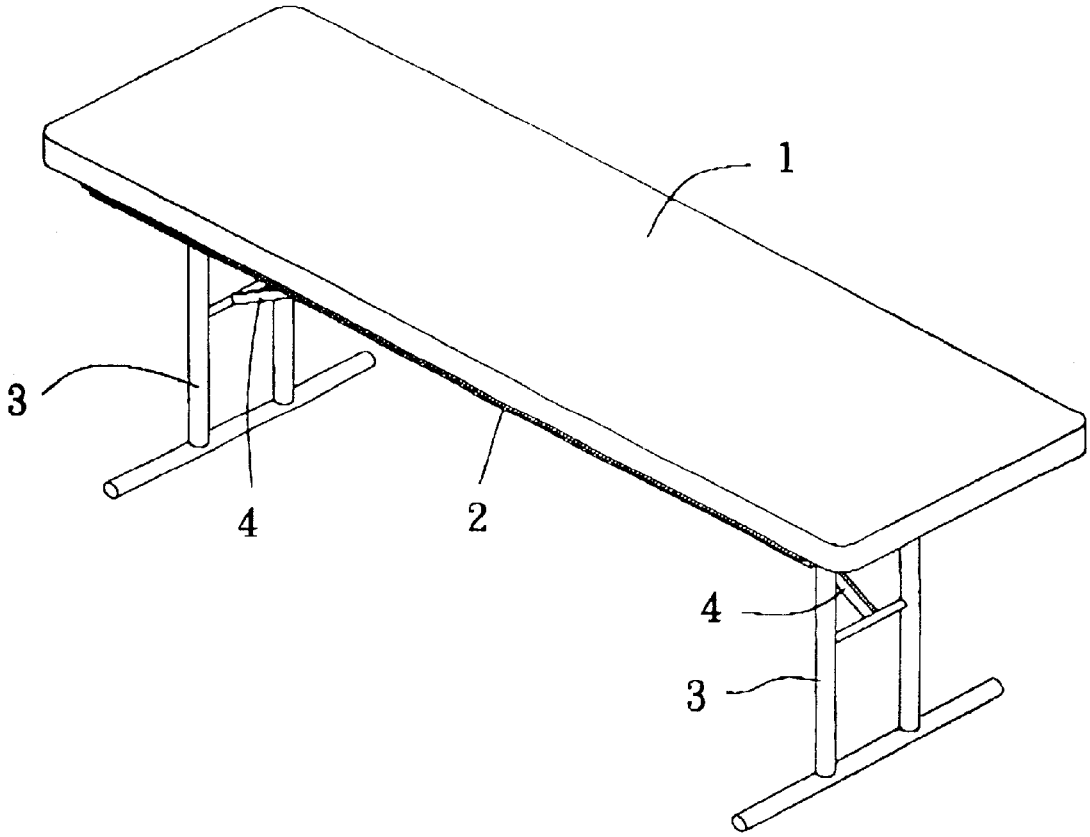
FIG. 1 is a perspective view of the preferred embodiment of the folding table according to this invention.
Figure 2:
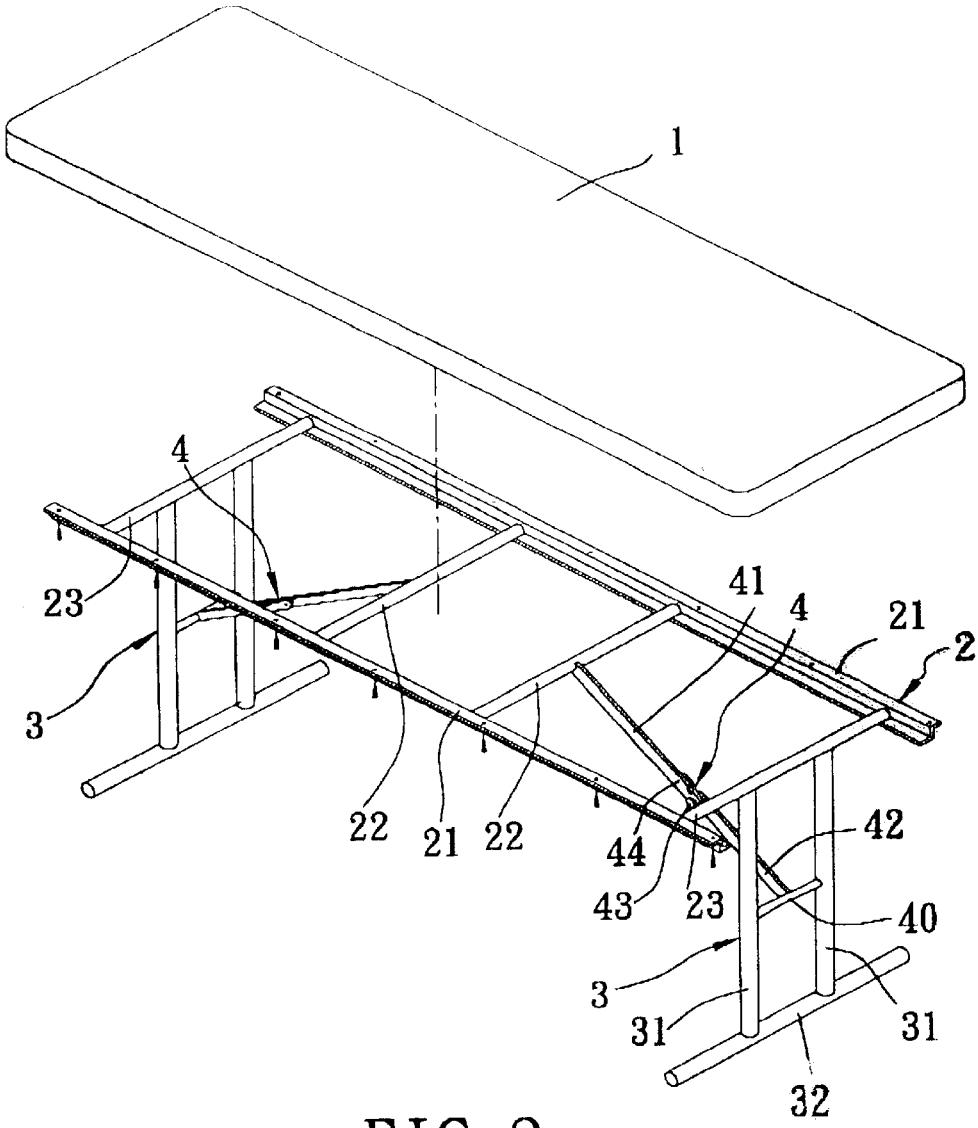
FIG. 2 is a partly exploded perspective view of the folding table of FIG. 1.

Referring to FIGS. 1 and 2, the preferred embodiment of the folding table according to this invention is shown to include a pair of support pedestals 3, a pair of side rails 2, a pair of foldable support braces 4, and a table top 1 mounted on the side rails 2.

The support pedestals 3 are spaced apart from each other in a longitudinal direction. Each of the support pedestals 3 has a top end formed with an end rail 23 that extends in a transverse direction transverse to the longitudinal direction and that has distal end segments opposite to each other in the transverse direction, and a bottom end adapted to be placed on a ground surface. Preferably, the bottom end of each of the support pedestals 3 is formed with a bottom rail 32 that is disposed parallel to the end rail 23 and that is adapted to be placed on the ground surface.

Figure 6:
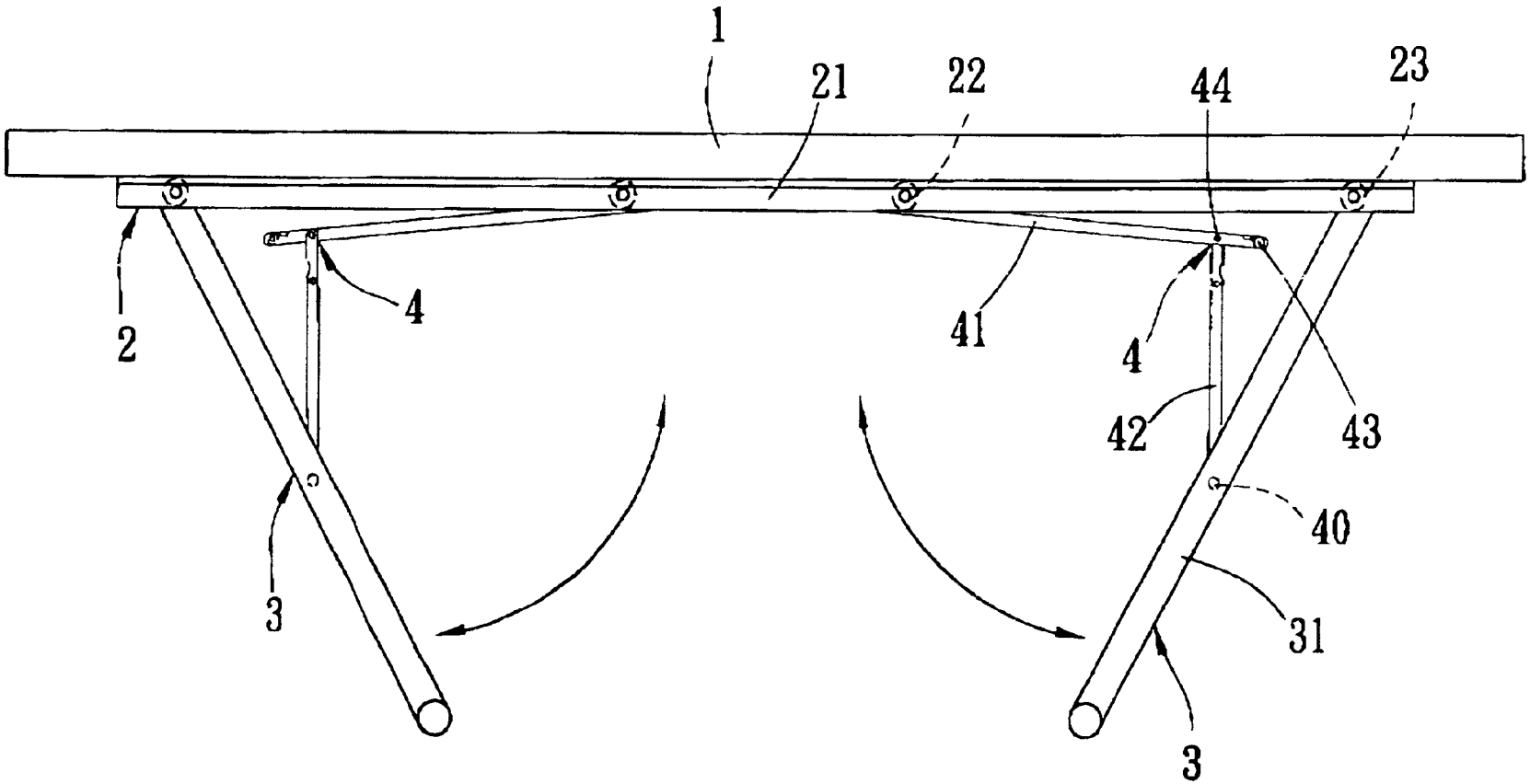
FIG. 6 is a schematic view of the folding table of the preferred embodiment.
Figure 7:
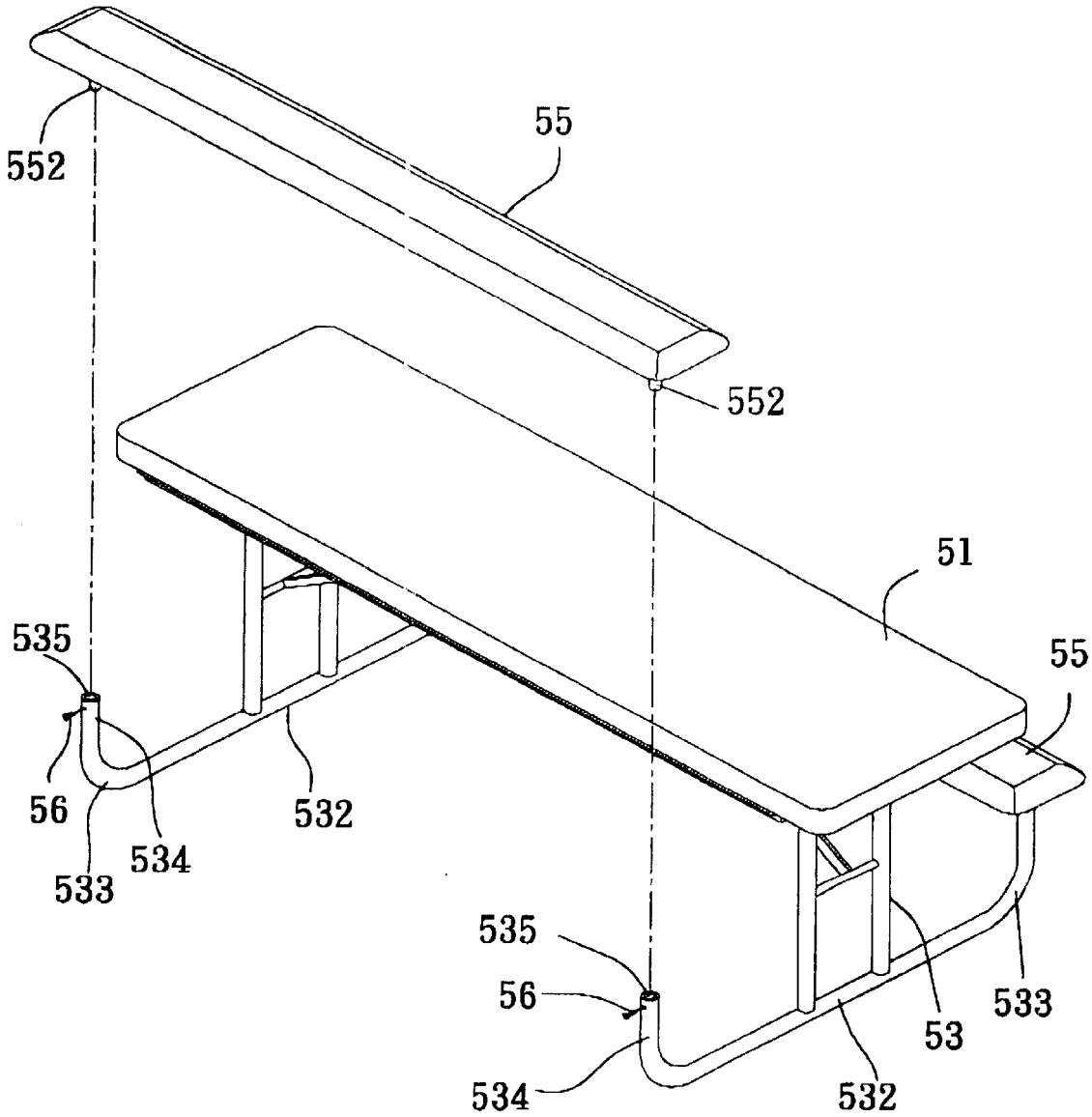
FIG. 7 is a partly exploded perspective view of another preferred embodiment of the folding table according to this invention.

The side rails 2 extend in the longitudinal direction and are spaced apart from each other in the transverse direction. Each of the side rails 2 has opposite ends connected pivotally and respectively to an adjacent pair of the distal end segments of the end rails 23 of the support pedestals 3. With further reference to FIG. 6, the support pedestals 3 are movable relative to the side rails 2 between a folded position, where the support pedestals 3 are disposed to lie adjacent to the side rails 2, and an unfolded position, where the support pedestals 3 are disposed generally transverse to the side rails 2.

Each of the support braces 4 props releasably a respective one of the support pedestals 3 in the unfolded position, and includes a rail connecting portion 41 and a pedestal connecting portion 42. The rail connecting portion 41 has a first end section connected pivotally to the side rails 2, and an opposite second end section. The pedestal connecting portion 42 has a first end segment connected pivotally to a respective one of the support pedestals 3, and an opposite second end segment that is disposed to lie against the second end section of the rail connecting portion 41. The rail connecting portion 41 and the pedestal connecting portion 42 are generally aligned with each other in an extended state of the support brace 4 to prop the respective one of the support pedestals 3 in the unfolded position.

Figure 3:
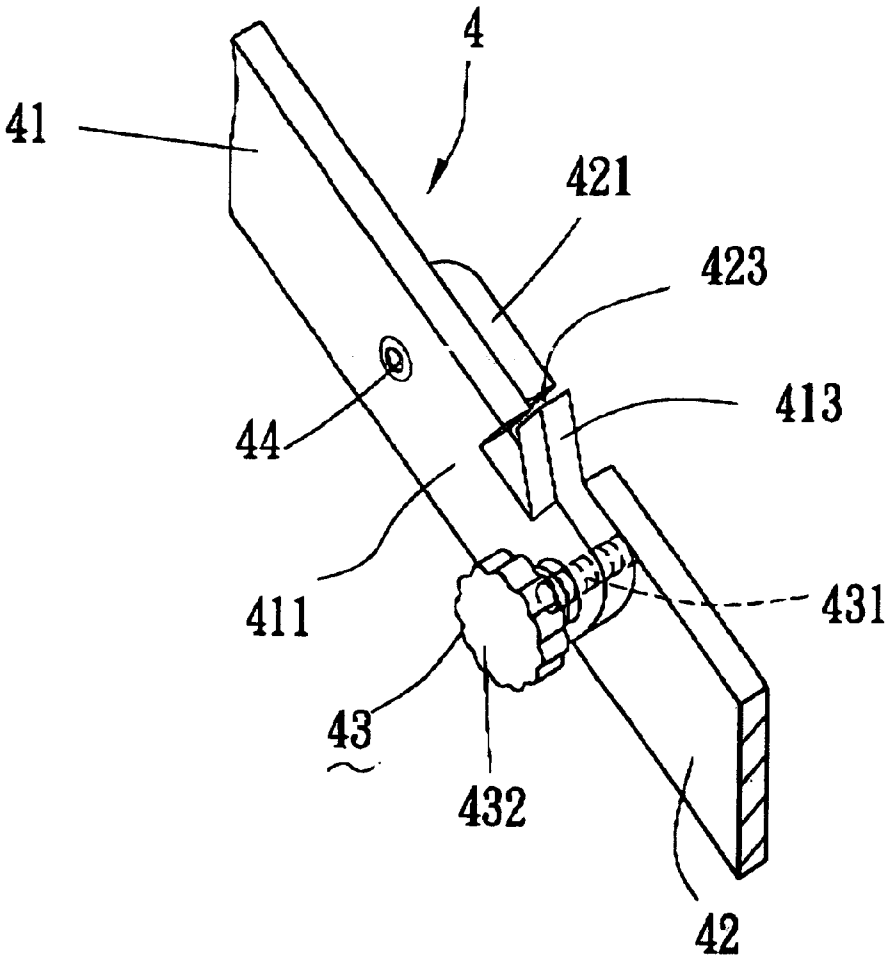
FIG. 3 is a fragmentary perspective view showing a foldable support brace of the preferred embodiment at an extended state.
Figure 4:
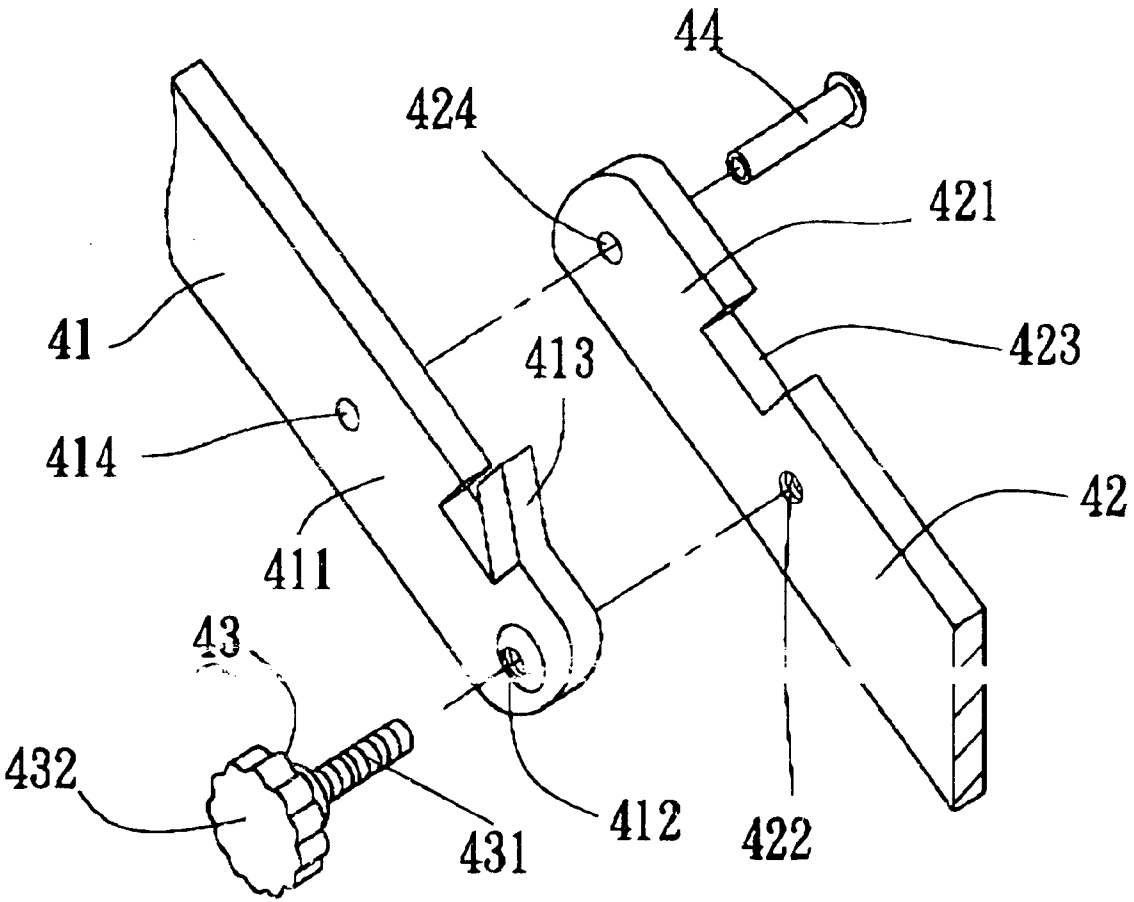
FIG. 4 is an exploded fragmentary perspective view of the foldable support brace of FIG. 3.
Figure 5:
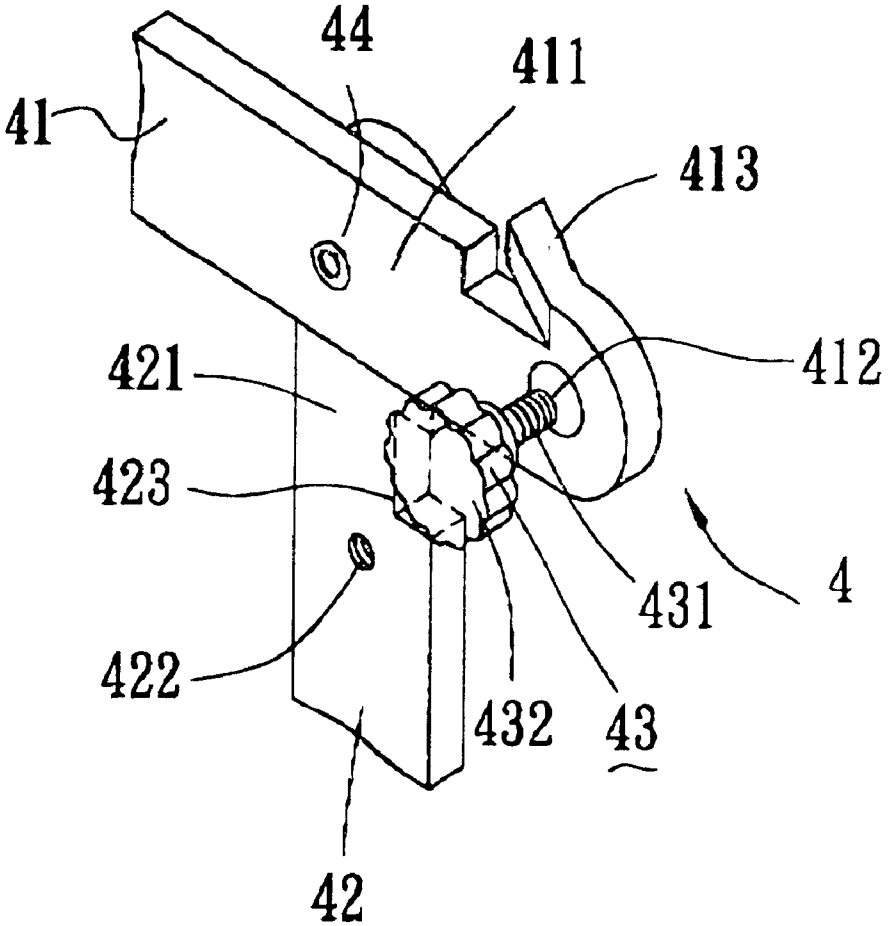
FIG. 5 is a fragmentary perspective view showing the foldable support brace of the preferred embodiment at a folded state.

Referring to FIGS. 3, 4 and 5, the second end section of the rail connecting portion 41 is formed with first and second fastener holes 414, 412. The second end segment of the pedestal connecting portion 42 is formed with a third fastener hole 424 that is registered with the first fastener hole 414, and a fourth fastener hole 422 that is registered with the second fastener hole 412 when the support brace 4 is at the extended state.

The second end segment of the pedestal connecting portion 42 of each of the support braces 4 is formed with a notch 423. The second end section of the rail connecting portion 41 of each of the support braces 4 is formed with a projection 413 that extends into the notch 423 to ensure that the fourth fastener hole 422 is registered with the second fastener hole 412 when the support brace 4 is at the extended state.

Each of the support braces 4 further includes a pivot fastener 44, such as a rivet, extending through the first and third fastener holes 414, 424 for connecting pivotally the second end segment of the pedestal connecting portion 42 to the second end section of the rail connecting portion 41, and a locking fastener 432 extending through one of the second and fourth fastener holes 412, 422 and removably engaging the other of the second and fourth fastener holes 412, 422 to retain releasably the support brace 4 at the extended state. In this embodiment, the fourth fastener hole 422 is formed with an internal screw thread, and the locking fastener 43 is a screw fastener having a threaded shank 431 and an operating knob 432 on the end of the threaded shank 431.

Referring once again to FIG. 2, the folding table further includes a pair of cross rails 22 that extend in the transverse direction, that are disposed between the end rails 23 of the support pedestals 3, and that are spaced apart from the end rails 23 in the longitudinal direction. Each of the cross rails 22 has opposite rails ends connected pivotally and respectively to the side rails 2, and an intermediate rail portion that is disposed between the rail ends. The first end section of the rail connecting portion 41 of each of the support braces 4 is connected to the intermediate rail portion of a respective one of the cross rails 22, thereby connecting pivotally the rail connecting portion 41 to the side rails 2.

Each of the support pedestals 3 further includes a pair of support rods 31 extending transverse to the end rail 23 and spaced apart from each other in the transverse direction. Each of a pair of connecting rods 40 extends parallel to the end rail 23 of a respective one of the support pedestals 3, and has opposite rod ends connected pivotally and respectively to the support rods 31 of the respective one of the support pedestals 3, and an intermediate rod portion that is disposed between the rod ends. The first end segment of the pedestal connecting portion 42 of each of the support braces 4 is connected to the intermediate rod portion of a respective one of the connecting rods 40, thereby connecting pivotally the pedestal connecting portion 42 to the respective one of the support pedestals 3.

Referring to 7, in another preferred embodiment, the bottom rail 532 of each of the support pedestals 53 has a pair of extension segments 533 that extend in the transverse direction beyond a respective adjacent longitudinal edge of the table top 51. Each extension segment 533 is formed with a bench mounting post 534 that extends upwardly therefrom. The folding table of this embodiment further includes two bench members 55, each of which extends between and is mounted removably on the bench mounting posts 534 of the support pedestals 53. Preferably, the bench mounting post 534 is formed with an insert hole 535. Each of the bench members 55 has a bottom surface formed with a pair of insert stubs 552 for insertion into the insert holes 535 in the bench mounting posts 534. Additionally, the folding table of this embodiment further includes a retainer unit 56, such as screw fasteners, for retaining removably the insert stubs 552 in the insert holes 535.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A folding table, comprising:

a pair of support pedestals spaced apart from each other in a longitudinal direction, each of said support pedestals having a top end formed with an end rail that extends in a transverse direction transverse to the longitudinal direction and that has distal end segments opposite to each other in the transverse direction, and a bottom end adapted to be placed on a ground surface;

a pair of side rails that extend in the longitudinal direction and that are spaced apart from each other in the transverse direction, each of said side rails having opposite ends connected pivotally and respectively to an adjacent pair of said distal end segments of said end rails of said support pedestals such that said support pedestals are movable relative to said side rails between a folded position, where said support pedestals are disposed to lie adjacent to said side rails, and an unfolded position, where said support pedestals are disposed generally transverse to said side rails;

a pair of foldable support braces, each of which props releasably a respective one of said support pedestals in the unfolded position and includes a rail connecting portion and a pedestal connecting portion, said rail connecting portion having a first end section connected pivotally to said side rails, and an opposite second end section, said pedestal connecting portion having a first end segment connected pivotally to a respective one of said support pedestals, and an opposite second end segment that is disposed to lie against said second end section of said rail connecting portion, said rail connecting portion and said pedestal connecting portion being generally aligned with each other in an extended state of said support brace to prop the respective one of said support pedestals in the unfolded position;

said second end section of said rail connecting portion being formed with first and second fastener holes, said second end segment of said pedestal connecting portion being formed with a third fastener hole that is registered with said first fastener hole, and a fourth fastener hole that is registered with said second fastener hole when said support brace is at the extended state;

one of said second end segment of said pedestal connecting portion and said second end section of said rail connecting portion of each of said support braces being formed with a notch, the other of said second end segment of said pedestal connecting portion and said second end section of said rail connecting portion of each of said support braces being formed with a projection that extends into said notch to ensure that said fourth fastener hole is registered with said second fastener hole when said support brace is at the extended state;

each of said support braces further including a pivot fastener extending through said first and third fastener holes for connecting pivotally said second end segment of said pedestal connecting portion to said second end section of said rail connecting portion, and a locking fastener extending through one of said second and fourth fastener holes and removably engaging the other of said second and fourth fastener holes to retain releasably said support brace at the extended state; and a table top mounted on said side rails.

2. The folding table of claim 1, wherein said locking fastener is a screw fastener.

3. The folding table of claim 1, further comprising a pair of cross rails that extend in the transverse direction, that are disposed between said end rails of said support pedestals, and that are spaced apart from said end rails in the longitudinal direction, each of said cross rails having opposite rail ends connected pivotally and respectively to said side rails, and an intermediate rail portion that is disposed between said rail ends, said first end section of said rail connecting portion of each of said support braces being connected to said intermediate rail portion of a respective one of said cross rails, thereby connecting pivotally said rail connecting portion to said side rails.

4. The folding table of claim 1, wherein each of said support pedestals further includes a pair of support rods extending transverse to said end rail and spaced apart from each other in the transverse direction, said folding table further comprising a pair of connecting rods, each of which extends parallel to said end rail of a respective one of said support pedestals, and has opposite rod ends connected pivotally and respectively to said support rods of the respective one of said support pedestals, and an intermediate rod portion that is disposed between said rod ends, said first end segment of said pedestal connecting portion of each of said support braces being connected to said intermediate rod portion of a respective one of said connecting rods, thereby connecting pivotally said pedestal connecting portion to the respective one of said support pedestals.

5. The folding table of claim 1, wherein said bottom end of each of said support pedestals is formed with a bottom rail that is disposed parallel to said end rail and that is adapted to be placed on the ground surface.

6. The folding table of claim 5, wherein said bottom rail of each of said support pedestals has an extension segment that extends in the transverse direction beyond an adjacent longitudinal edge of said table top, said extension segment being formed with a bench mounting post that extends upwardly therefrom, said folding table further comprising a bench member that extends between and that is mounted removably on said bench mounting posts of said support pedestals.

7. The folding table of claim 6, wherein said bench mounting post is formed with an insert hole, said bench member having a bottom surface formed with a pair of insert stubs for insertion into said insert holes in said bench mounting posts.

8. The folding table of claim 7, further comprising a retainer unit for retaining removably said insert stubs in said insert holes.

* * * * *